US005129351A

United States Patent [19]

Feder

[11] Patent Number: 5,129,351

[45] Date of Patent: Jul. 14, 1992

[54] SIGNALLING DEVICE FOR SCUBA DIVERS

[76] Inventor: Irving Feder, 19150 W. Dixie Hwy., Miami, Fla. 33160

[21] Appl. No.: 696,223

[22] Filed: May 6, 1991

[51] Int. Cl.[5] ..... B63C 11/02; B63C 11/26; B63C 11/52; B63C 9/20

[52] U.S. Cl. ..... 116/307; 116/26; 405/186

[58] Field of Search ..... 116/306, 26, 27, 152, 116/307; 441/12, 129, 131, 136; 446/247, 417, 418, 422, 486; 405/186, 185; 367/910, 191

[56] References Cited

U.S. PATENT DOCUMENTS

| | | | |
|---|---|---|---|
| 1,109,811 | 9/1914 | Wood | 116/27 |
| 4,127,053 | 11/1978 | Cohen | 446/422 X |
| 4,455,718 | 6/1984 | Finnern | 405/186 |
| 4,858,204 | 8/1989 | Holston et al. | 116/26 X |
| 4,861,300 | 8/1989 | Casagrande et al. | 441/131 X |
| 4,976,642 | 12/1990 | Wilkie | 441/131 |

*Primary Examiner*—William A. Cuchlinski, Jr.
*Assistant Examiner*—John L. Beres
*Attorney, Agent, or Firm*—Herbert L. Lerner; Laurence A. Greenberg

[57] ABSTRACT

A signalling device for scuba divers is disclosed. A substantially cylindrical rod has an opening formed therein along its longitudinal axis. A closed loop of resilient latex tubing extends through the opening. The loop of tubing is slipped over the scuba tank. The rod may be banged against the scuba tank for the purpose of signalling by pulling the rod away from the tank and then releasing it.

8 Claims, 2 Drawing Sheets

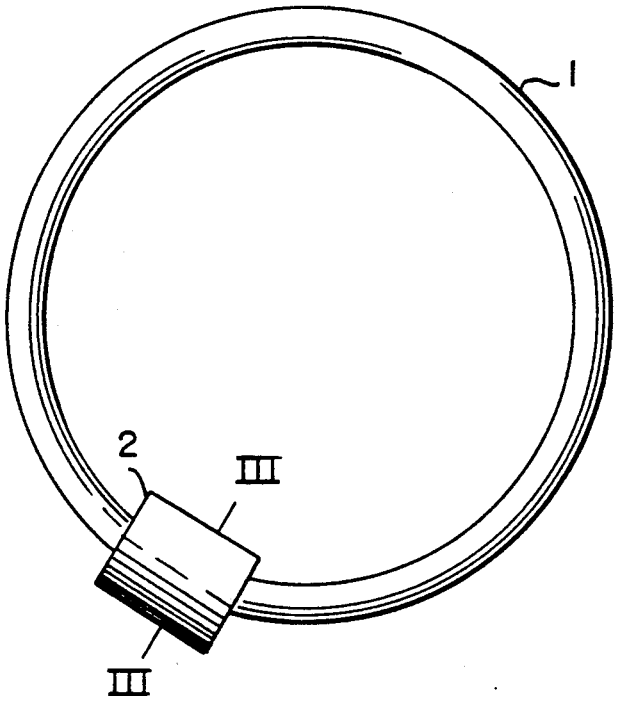
Fig.1
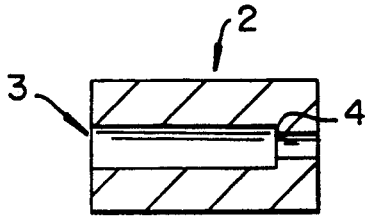
Fig.4
Fig.2
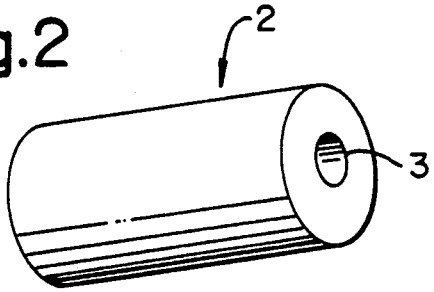
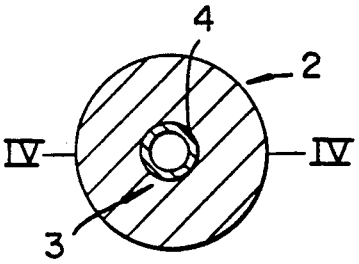
Fig.3
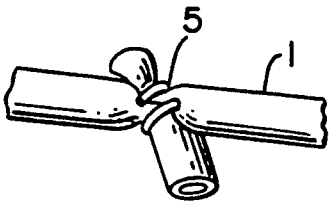
Fig.5

SIGNALLING DEVICE FOR SCUBA DIVERS

BACKGROUND OF THE INVENTION

1. Field of the Invention

The invention relates to a signalling device and emergency alert system for scuba divers.

2. Description of the Prior Art

A signalling device of this general type has been known in the art, with a resilient rubber loop attaching a signalling ball to a scuba tank. The tubing material in the art has been made of thermoplastic rubber. Several disadvantages have become apparent, such as the relatively limited elasticity of the material, the rubber stretches out and does not return to its original size, the rubber is prone to snap breakage and, due to a relatively limited coefficient of elasticity, the signalling device is not readily interchangeable among different tank sizes.

In the prior art, the free ends of the tubing material have been connected with a plastic barb and glue. These connections have been known to come apart and signalling devices have been lost.

Finally, many scuba divers wear gloves. A round ball, as it has been used in the art, cannot be easily gripped since all of the surfaces are pitched and the diver's gloves or hands are wet.

SUMMARY OF THE INVENTION

It is accordingly an object of the invention to provide a signalling device for scuba divers, which overcomes the hereinafore-mentioned disadvantages of the heretofore-known devices of this general type and which provides greater elasticity of the attachment tubing, better retention memory of the original size and greater resistance to snap breakage. Furthermore, due to the greater elasticity of latex tubing, the signalling device is readily interchangeable among different size tanks. The connection between the free ends of the tubing is vastly improved over the prior art in that it cannot come apart, and the banging device has been improved to provide for better gripping.

With the foregoing and other objects in view there is provided, in accordance with the invention, a signalling device for scuba divers using a scuba tank, comprising a substantially cylindrical rod having end faces, a longitudinal axis and an opening formed therein extending between the end faces along the axis, means in the form of a closed loop of resilient latex tubing extending through the opening for resiliently securing the cylindrical rod against the surface of the scuba tank and forming an audible signal when the rod is pulled away from the surface and then released.

With the resilient latex tubing it is ensured that the device can easily be interchanged among different sizes of scuba tanks. For example, a loop which is adapted to a 50 cubic ft. tank can also be used for much larger tanks.

In accordance with another feature of the invention, the two free ends of the latex tubing are connected by clamping in the vicinity of the free ends. It is therefore ensured that the closed loop can only be undone by severing the latex tubing itself.

In accordance with a further feature of the invention, the clamping ring and the free ends are disposed inside the opening in the cylindrical rod. The connection is thereby further reinforced, in that the free ends fold back onto the tubing when they are pulled into the opening in the banger rod. Furthermore, the connection and the clamping ring are hidden from view.

In accordance with an added feature of the invention, the clamping ring is a stainless steel ring.

In accordance with an additional feature of the invention, the tubing has a positive buoyancy at least equal to the weight of the rod for ensuring floatation of the signalling device. Should the divers wish to handle the signalling device under water, the device will not fall to the bottom, but will either remain at the respective diving level or ascend to the surface. In accordance with yet another feature of the invention, accordingly, the the tubing is hollow.

In accordance with yet an additional feature of the invention, the tubing is natural latex tubing.

In accordance with a concomitant feature of the invention, a plurality of cylindrical rods is attached to the latex tubing loop. In this way it is assured that a rod will be accessible, relatively independent of the position on the tank.

The device in accordance with the invention is known as a Tank Banger or a diver's emergency alert and buddy signal. It is an easily activated alarm that enables divers to get their colleages' attention. This is necessary in the event or an equipment failure or a physical problem. A diver may need immediate assistance. The loud clang made by the Tank Banger assures that the affected diver can get the other divers' attention. The usefulness of the device is also apparent in non-emergency situations, i.e., to get the attention of an entire group by dive instructors, or to point out interesting underwater features.

The signalling device is simply slid up any compressed air tank used by scuba divers. The latex tubing easily expands to securely remain in position on any size tank. The delrin rod is placed where it is easily reached when necessary to activate.

To use the Tank Banger as an emergency alarm, the delrin rod is simply pulled away from the tank and released. The intensity of the sound will vary with the distance the rod is pulled away from the tank and the material that the tank is constructed from, usually steel or aluminum.

An additional use for the signalling device is as a convenient place to secure a diver's secondary (backup for emergencies) regulator during the dive. By sliding the secondary regulator into the elastic tube of the signalling device, it is kept from freely dangling. This prevents damage to the regulator and additionally places it in an accessible position that is fixed and known to the diver.

Other features which are considered as characteristic for the invention are set forth in the appended claims.

Although the invention is illustrated and described herein as embodied in a signalling device for scuba divers, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 1 is an elevational view of the signalling device according to the invention;

FIG. 2 is a perspective view of banger rod according to the invention, slightly enlarged as compared to FIG. 1;

FIG. 3 is a cross-sectional view of the banger rod along the line III—III of FIG. 1;

FIG. 4 is a cross-sectional view of the banger rod along the line IV—IV of FIG. 3;

FIG. 5 is a partial view of the attachment tubing and the clamping ring; and

DESCRIPTION OF THE PREFERRED EMBODIMENTS

Figure 6:
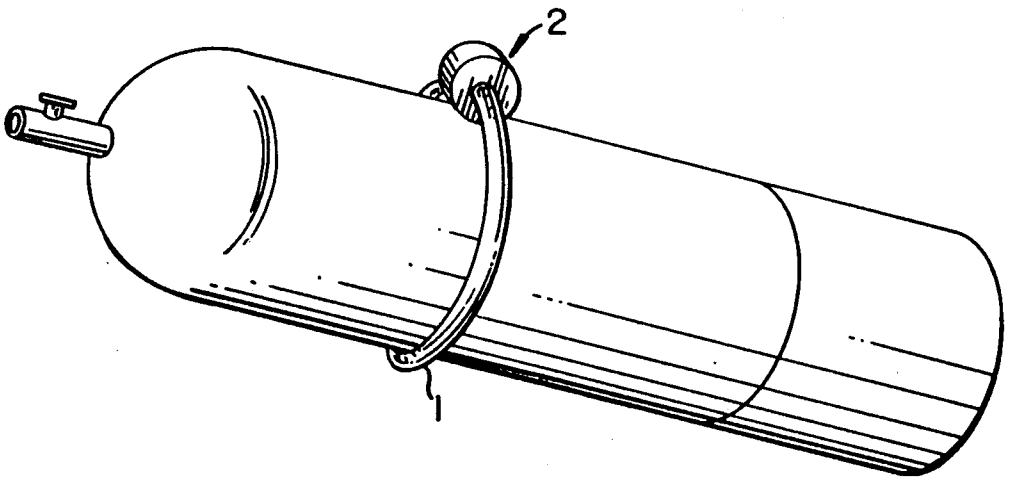
FIG. 6 is a perspective view of a scuba tank with the signalling device according to the invention.

Referring now to the figures of the drawing in detail and first, particularly, to FIG. 1 thereof, there is seen a diver's signalling device with attachment tubing 1 and a banger rod 2. The tubing 1 is preferably made of natural latex tubing with an outer diameter of about 5/16 inches and inner diameter of about 3/16 inches. It is readily apparent that a wide variety of attachment tubes may be used, of varying thickness and resiliency. The tubing 1 has a length which is adapted to the diameter of a non-illustrated scuba tank, i.e. a preferable length would be approximately 16 inches.

The banger rod 2 may be made of DELRIN, a hard, durable plastic, available from E. I. Dupont. A preferable embodiment has a diameter of about one inch and a length of just over one inch. An opening 3 extends through the entire length of the rod 2, along the longitudinal axis thereof. The diameter of the opening 3 is adapted to the outer diameter of the attachment tubing 1. As seen in FIG. 4, the opening 3 is provided with a step 4. The step is easily manufactured by simply drilling a smaller diameter hole from one side of the banger 2, as compared to the other side.

After an appropriate length of latex tubing 1 has been cut, it is threaded through the opening 3. Subsequently, the two ends of the tubing 1 are permanently connected by means of a clamping ring 5. The clamping ring 5 is a so-called hog ring, made of stainless steel. By compressing the ring, the ends of the latex tubing are permanently mechanically coupled. It is also possible to reinforce the connection with glue or by vulcanizing the ends of the latex tubing, and thus chemically bond the two ends. In a manufacturing environment, the clamping ring 5 may be entirely replaced by such vulcanized integration.

It is, of course, equally possible to use a plurality of rods 2. In this way it is assured that the rod 2 is always accessible for pulling, regardless of the angle from which the other diver is approached.

After the two ends of the tubing 1 have been connected, the clamping ring 5, and thus the two ends of the tubing 1, are pulled into the opening 3. By pulling the connection into the opening 3, at least one of the free ends of the tubing 1 is folded backwards, so that the clamping ring connection becomes virtually inseparable. In the case of the banger 2 shown in FIG. 4, the ring 5 would enter from the left-hand side of the banger 2, until the ring and the ends cannot move past the step 4.

By choosing the latex tubing 1 such that its positive buoyancy in water is greater than, or at least equal to, the underwater weight of the banger rod 2, it is ensured that the signalling device floats in water. For that purpose, the latex tubing 1 may be hollow.

I claim:

1. A signalling device for scuba divers using a scuba tank, comprising a substantially cylindrical rod having end faces, a longitudinal axis and an opening formed therein extending between said end faces along said axis, means in the form of a closed loop of resilient latex tubing extending through said opening for resiliently securing said cylindrical rod against the surface of the scuba tank and forming an audible signal when said rod is pulled away from said surface and then released.

2. The signalling device according to claim 1, wherein said latex tubing has two free ends, including a clamping ring for forming said loop by clamping said tubing in the vicinity of said free ends.

3. The signalling device according to claim 2, wherein said clamping ring and said free ends are disposed inside said opening in said cylindrical rod.

4. The signalling device according to claim 2, wherein said clamping ring is a stainless steel ring.

5. The signalling device according to claim 1, wherein said tubing has a positive buoyancy at least equal to the weight of said rod for ensuring floatation of the signalling device.

6. The signalling device according to claim 5, wherein said tubing is hollow.

7. The signalling device according to claim 1, wherein said tubing is natural latex tubing.

8. The signalling device according to claim 1, wherein said cylindrical rod is a plurality of cylindrical rods.

* * * * *